United States Patent [19]

Saito

[11] Patent Number: 4,991,380

[45] Date of Patent: Feb. 12, 1991

[54] PACKAGING APPARATUS

[76] Inventor: Tsutomu Saito, Sannou 2-16-5, Ota-ku, Tokyo, Japan

[21] Appl. No.: 489,479

[22] Filed: Mar. 6, 1990

[30] Foreign Application Priority Data

May 2, 1989 [JP] Japan ..... 1-112149

[51] Int. Cl.[5] ..... B65B 9/02; B65B 51/30

[52] U.S. Cl. ..... 53/553; 53/586; 53/373; 156/323

[58] Field of Search ..... 53/228, 230, 373, 553, 53/586, 582; 156/323

[56] References Cited

U.S. PATENT DOCUMENTS 3,170,275 2/1965 Rohdin ..... 53/373

3,210,910 10/1965 Seefluth ..... 53/373

4,209,958 7/1980 Bailey ..... 53/373 X

*Primary Examiner*—John Sipos

*Attorney, Agent, or Firm*—Michael N. Meller

[57] ABSTRACT

Apparatus for feeding and withdrawing a support member for a fusing operation of film end portions in film packaging is described wherein sheet member is interspersed between the support member and the film in the fusion position. The sheet member is normally out of contact with the support member until the support member is moved into the fusion position. When the support member is moved from the fusion position back to the normal position, the sheet member prevents the support member from entering into frictional engagement with the film. The sheet member may be arranged on both the front and rear surfaces of the support member so that damage is avoided due to direct contact between the support member and both the film and the article being packaged.

20 Claims, 8 Drawing Sheets

PACKAGING APPARATUS

This invention relates to an apparatus for feeding and withdrawing a support member for fusing operation in packaging an article. More particularly, this invention relates to such apparatus using a stretchable and shrinkable resin film when both end portions of the film wound around the article in a tension state are overlapped and fused.

In known constructions of such packaging apparatus, when both end portions of a film wound around an article to be packaged in a tension state are overlapped and fused together, a support member is placed between a surface of the article and the overlapped portion of the film. The support member has at least the same length as that portion of the film which is to be fused. A pressurizing member is pressed against the support member so as to heat and fuse the overlapped portion of the film. When the support member is withdrawn from the fusion-processing position after the fusing operation, it scratches both an outer surface of the article being packaged and an inner surface of the fused portion at both end portions of the film due to friction. This damages the film and the surface of the article. In particular, cutting damages frequently occur in the film due to shrinkage of the film.

Conventionally, a member with a smooth surface having substantially the same length as the width of the film is used as the support member and the support member is usually fed into and withdrawn from the fusion-processing position.

In such conventional apparatus, the film and the article are damaged due to frictional engagement between the support member and the film or the article when the conventional support member is fed in and withdrawn. Also, the increased space needed for feeding and withdrawing the relatively long support member to and from the fusion-processing position causes many difficulties and inconveniences.

In order to overcome the problems caused by conventional apparatus, apparatus incorporating the principles of the present invention is constructed such that the surface of a support member which faces at least a fused portion of the film is allowed to contact the film through a sheet member. The support member for the fusing operation is formed in a bendable chained form in order to substantially eliminate the inconveniences found in the prior art. The support member is fed into a fusion-processing position along a surface of the article in the longitudinal direction of a fused adhesion line. The support member is successively covered at least on its surface with a sheet member from the tip end thereof. The surface of the support member is arranged as a supporting surface having at least the same length as that portion of the film which is to be fused. Thereafter, both end portions of the film are overlapped on the supporting surface and fused together. The support member is withdrawn from the fusion-processing position while the sheet member is successively peeled off toward the side of said support member from the front tip of an inner surface of the fused portion upon completion of the fusion.

In another embodiment a plurality of short members are successively joined together in an appropriate length into a freely bendable chained support member.

BRIEF DESCRIPTION OF THE DRAWINGS

Preferred embodiments of the present invention are shown in the accompanying drawings wherein.

Embodiments of the present invention will be described with reference to the accompanying drawings.

Figure 1:
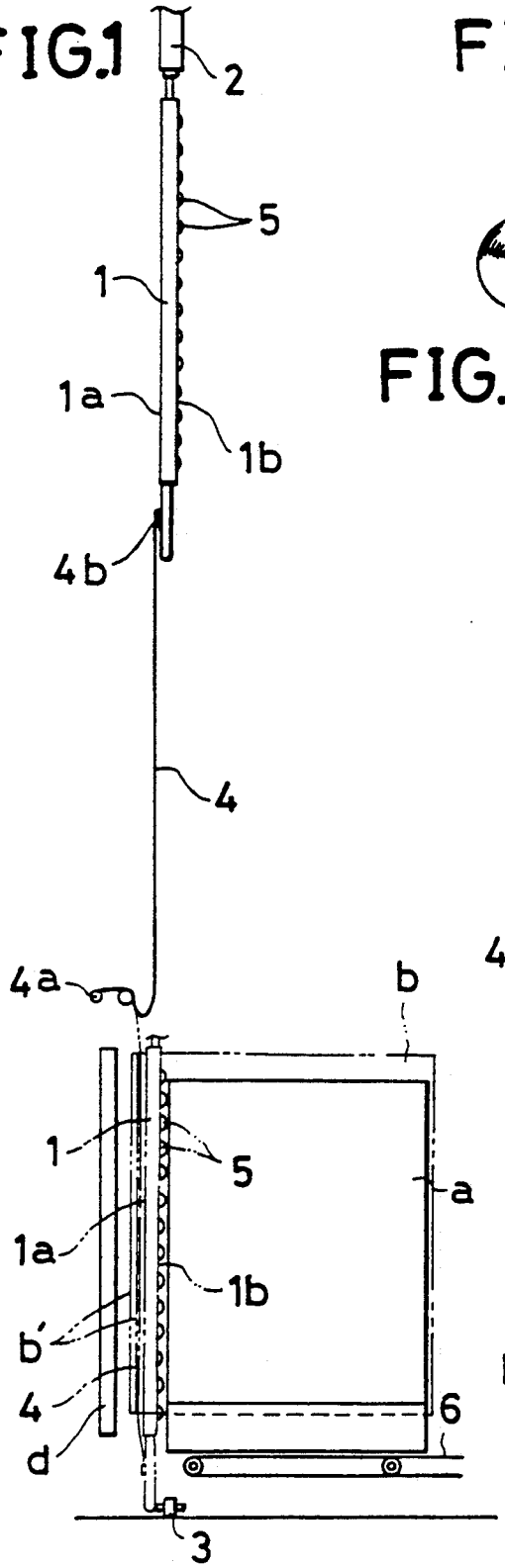
FIG. 1 is a side elevational view showing an apparatus having a sheet member placed at only one surface of the support member.
Figure 3:
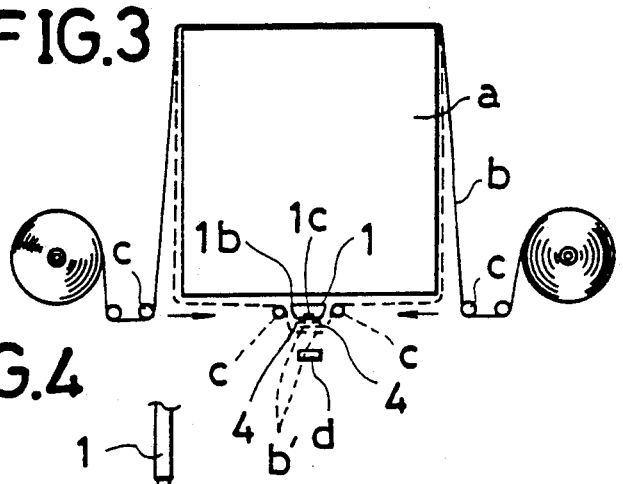
FIG. 3 is a top plan view of the apparatus shown in FIG. 1.

FIGS. 1 and 3 illustrate a basic embodiment of the present invention, wherein a sheet member (4) is provided on a surface of a support member (1) for a fusing operation. That is,the support member (1) has a supporting surface (1*a*) for supporting an overlapped portion of a stretchable and shrinkable packaging resin film (b) such as polyethylene to be wound around an article (a) in a tension state. Both end portions of the resin film are fused during the fusing operation.

As shown in FIG. 3, the packaging film (b) is pulled out from winding rollers at both sides, wound around three surfaces of the article (a) and held in that position. Prior to the fusing operation for the film end portions in that position, the support member (1) for the fusing operation is moved to the fourth surface of the article (a) about which the film (b) is not yet wound. The support member (1) is moved in a direction along a fused adhesion line of the film, i.e. from an upper part of the article (a) in this figure, with its rear surface (1*b*) being along the article. The support member (1) is fed in by a feeding and withdrawing device (2) such as a piston and cylinder mechanism or a winding and releasing mechanism, and its tip end is engaged, when necessary, with an engaging mechanism (3) and held stationary.

Then, the film (b) at both sides of the fourth surface of the article is pressed and held against the side surfaces of the support member (1) at a specified position by movable bars (c) and (c) as shown by a dotted line in FIG. 3. The film is cut by a processing mechanism, not shown, and its both cut ends (b') and (b') are overlapped with each other on the supporting surface (1*a*) of the supporting member (1). The overlapped portion of the film is heated and fused by contact pressure between a fusing die member (1*c*) provided on the supporting surface (1*a*) of member (1) and a movable pressing member (d).

Figure 2:
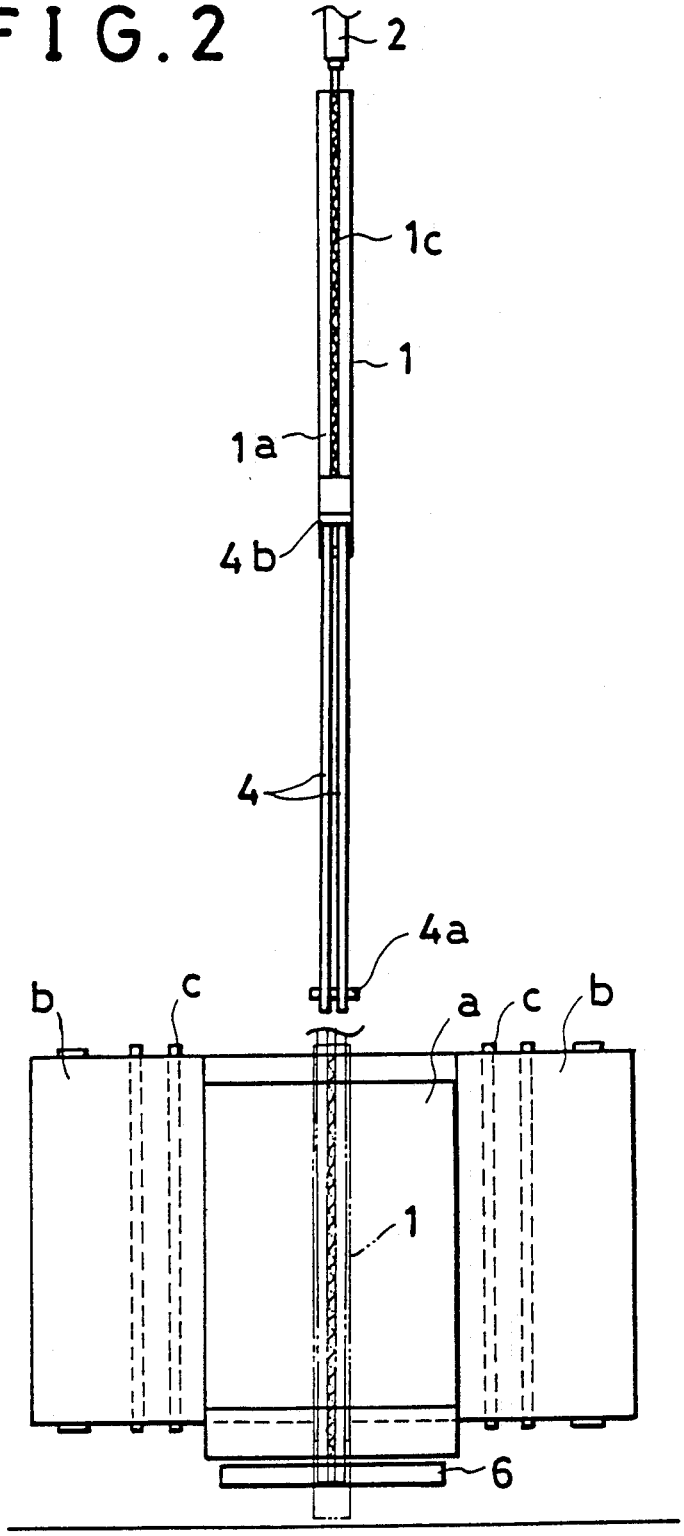
FIG. 2 is a front elevational view of the apparatus shown in FIG. 1.

When the support member (1) is advanced into the fusion-processing position, a smooth sheet member (4) made of flexible materials such as cloth, rubber, having one end (4*a*) fixed to a position at the side of the supporting surface (1*a*) of the support member (1) and having its other end (4*b*) fixed to a tip end of the support member (1), is successively advanced from a standby position shown in FIG. 1 by a solid line to a fusion-processing position at the front of the article (a) shown in an imaginary line in FIG. 1. The smooth sheet member (4) covers the supporting surface (1*a*) successively from its tip end along the supporting surface (1*a*) while the support member (1) is moved downward. Fusion is then performed as described above by overlapping the film end portions (b') and (b') on the supporting surface (1*a*). In the illustrated example, in which the fusing die member (1*c*) of the support member (1) is arranged at a central part of the supporting surface (1*a*), the sheet members (4) are arranged at both sides of the fusing die member (1*c*). This is best seen in FIG. 2.

As the fusing means for this embodiment, a fusing die member (1*c*) having an appropriate shape is provided on the support member (1) and a flat plate-like pressing member (d) is arranged for heating and pressing against the fusing die member (1*c*). However, a heating member may be provided on the support member (1) and a fusing die member having an arbitrary shape may be provided on the pressing member (d) which can be moved toward the support member (1) for the fusing operation.

Figure 12:
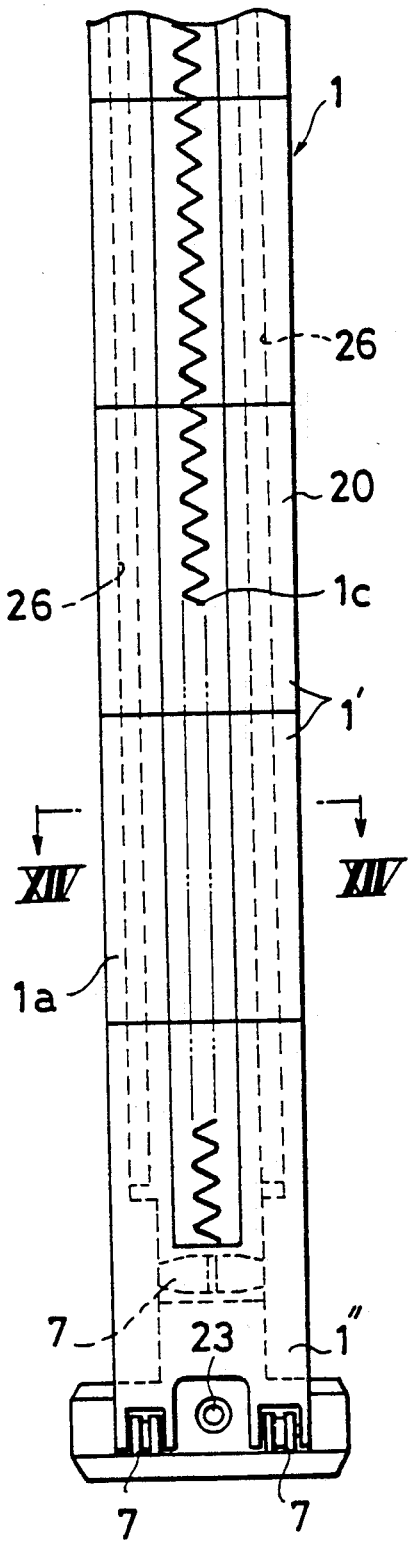
FIG. 12 is a front elevational view of a part of the chained support member.
Figure 13:
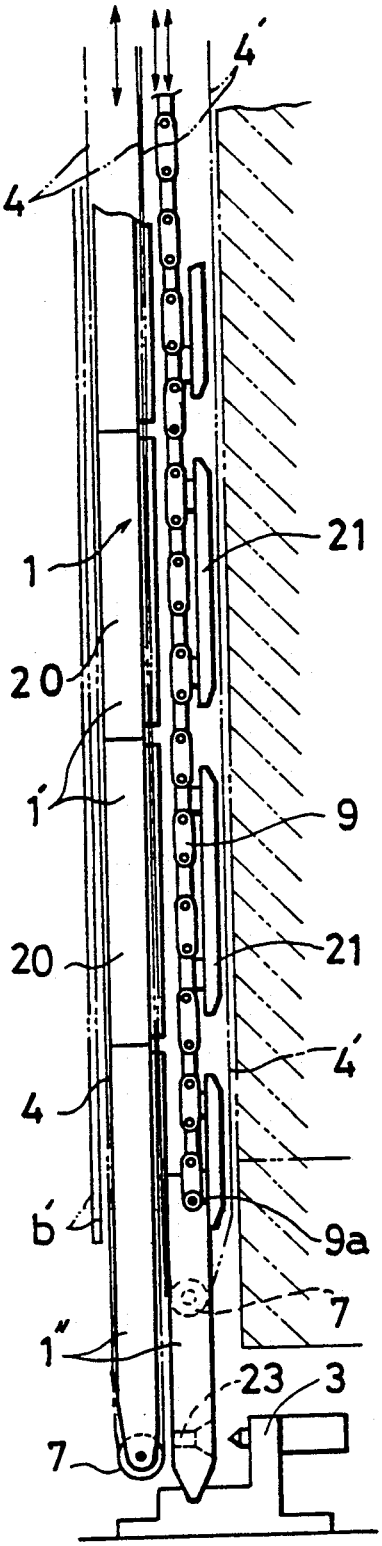
FIG. 13 is a side elevational view of the chained support member shown in FIG. 12.

A die form of the fusing die member (1*c*) may be of a bent fusing line as shown in FIG. 12 or of any desired form, and if, as a raw material of the fusing die member (1*c*), a resilient material such as heat-resistant rubber is used, a fusing die of any shape can easily be made and its resiliency can be effectively used during its pressing operation.

After both overlapped end portions (b') and (b') of the film (b) are fused, the pressing member (d) is retracted and the support member (1) is pulled out of the fusion-processing position by the feeding and withdrawing device (2). At this time, the sheet member (4) is pulled out together with the support member (1) while the sheet member is successively peeled off toward the side of said support member from an inner surface of the film (b). Thus the support member (1) is easily pulled out without being slid along the inner surface of the film (b) due to the presence of the sheet member (4).

Even if the film (b) moves into contact with the article (a) due to its shrinkage and tension, the support member (1) will not make direct contact with the inner surface of the film due to the presence of the sheet member (4). Further, since the sheet member (4) is pulled out while being peeled off from the inner surface of the film, damages to the film caused by friction are prevented.

In this embodiment, in which the sheet member (4) is present only on the front surface (1*a*) of the support member (1), in order to get smooth feeding and withdrawing of the support member (1), small-diameter, freely rotatable rollers (5) are arranged on a rear surface (1*b*) of the support member (1). This is shown in the embodiment of FIG. 1, and these rollers are rotated on the surface of the article (a) so as to facilitate feeding and withdrawing of the support member (1).

Figure 4:
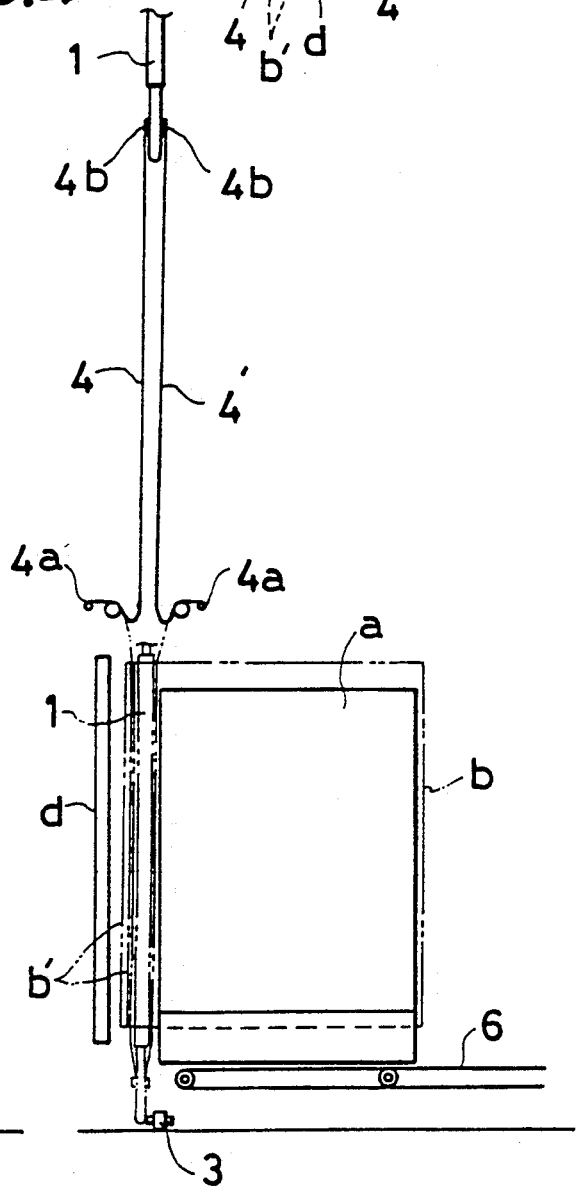
FIG. 4 is a side elevational view of an apparatus provided with sheet members at both the front and rear sides of the support member.

In addition, as shown in FIG. 4, in order to ensure prevention of damages to the article during the feeding and withdrawing operation of the support member (1), a sheet member (4') may also be provided at the rear surface of the support member (1) in the same manner as the foregoing description.

Figure 5A:
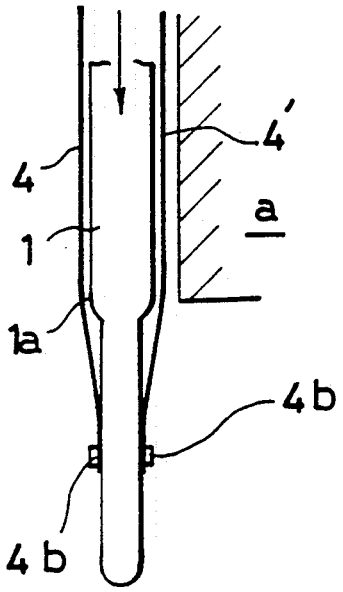
FIGS. 5A and 5B are side elevational views showing a feeding in and withdrawing of support and sheet members.
Figure 5B:
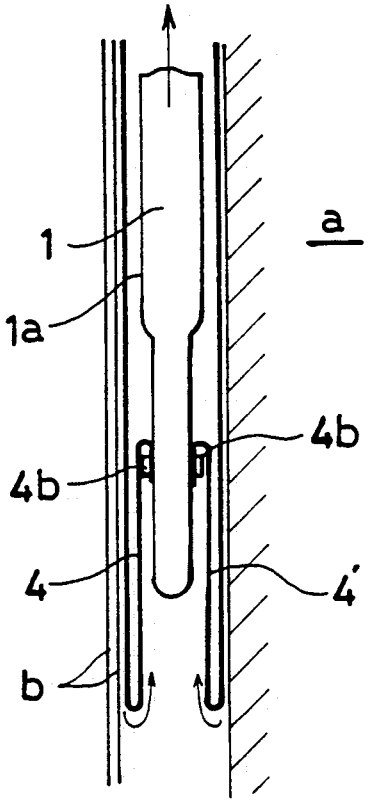

In FIGS. 5(*a*) and 5(*b*), respectively, is shown the manner in which the sheet member (4) is advanced along the surface of the support member (1) and is pulled out while it is peeled off from the inner surface of the fused film (b) during the feeding and withdrawing of the support member (1).

Reference numeral (6) in the figures denotes a transfer conveyor for the article (a).

Figure 6:
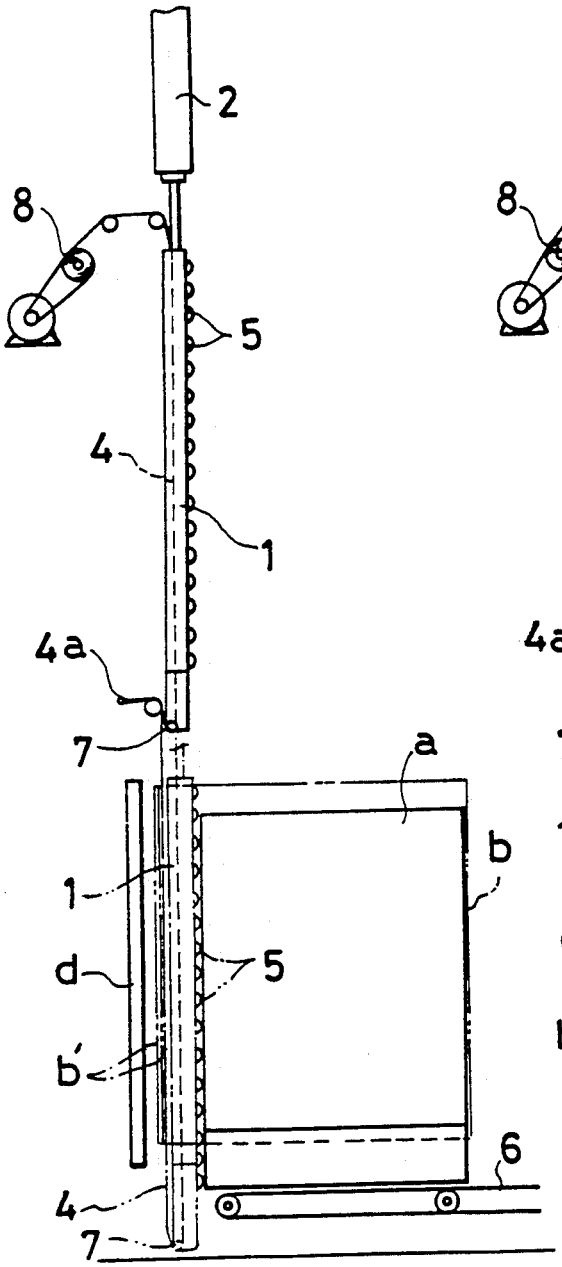
FIG. 6 is a side elevational view showing an apparatus for inserting a sheet member arranged at a front side into the support member and pulling it out.

FIG. 6 illustrates another embodiment for feeding and withdrawing the support member (1). In this embodiment, the sheet member (4) having its one end (4*a*) fixed to a position on the front side of the support member (1) is inserted into the support member (1) through a small diameter roller (7) at an end of the support member (1). Thereafter, the sheet member (4) is pulled out of the other end of the support member (1) and its terminal end is fixed to a feeding device (8).

In this case, the sheet member (4) is wound by the feeding device (8) while the support member (1) is being pulled out by the feeding and withdrawing device (2) from the fusion-processing position shown by an imaginary line in this figure. This arrangement keeps the support member (1) and the sheet member (4) at the standby position indicated by the solid line. For the fusing operation, as the support member (1) is advanced to the fusion-processing position at a front surface of the article (a), if the sheet member (4) is simultaneously rewound from the feeding device (8), the sheet member (4) is fed out while being moved along the supporting surface (1*a*) of the support member (1) as the support member (1) is moved downwardly. At this time, the rear surface of the support member (1) is moved by the small diameter rollers (5).

With this arrangement, when the fusing operation is completed, the sheet member (4) is taken up by the feeding device (8) while the support member (1) is being pulled upwards. The sheet member (4) is rolled up together with the support member (1) while being peeled off toward the side of said support member from the inner surface of the film (b) and thus the film surface may not be damaged by frictional engagement with the support member (1).

Figure 7:
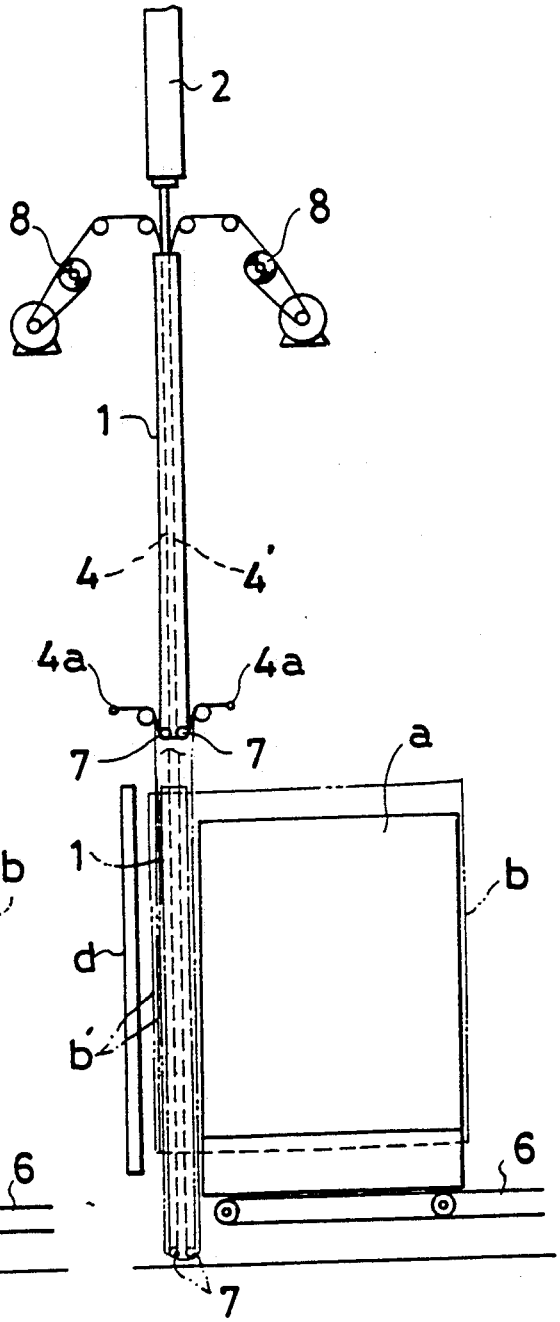
FIG. 7 is a side elevational view showing an apparatus for inserting the front and rear sheet members into the support member and pulling them out.

As shown in FIG. 7, if the sheet member (4') is arranged at a rear surface of the support member (1) in the same manner as with the front surface, damages to the surface of the article caused by frictional engagement with the support member (1) can be prevented.

In the above-mentioned embodiments, it has been illustrated that one rigid plate member having a length extending over the width of the film is used as the support member (1). In this case, as shown in FIGS. 1 and 4, in order to pull out the sheet member (4) up to the standby position, the support member (1) must be withdrawn a distance substantially three times its length. This requires substantial space for the fusing.

In the case of FIGS. 6 and 7, in which the sheet member (4) is inserted from the tip end of the support member (1) into the support member (1), pulled out of the other end and rolled up. The distance that the support member (1) must be moved can be reduced. However, since the pulling direction of the support member (1) is restricted in a plane including the fused adhesion line, this may be disadvantageous when packaging a relatively large-sized article.

Figure 8:
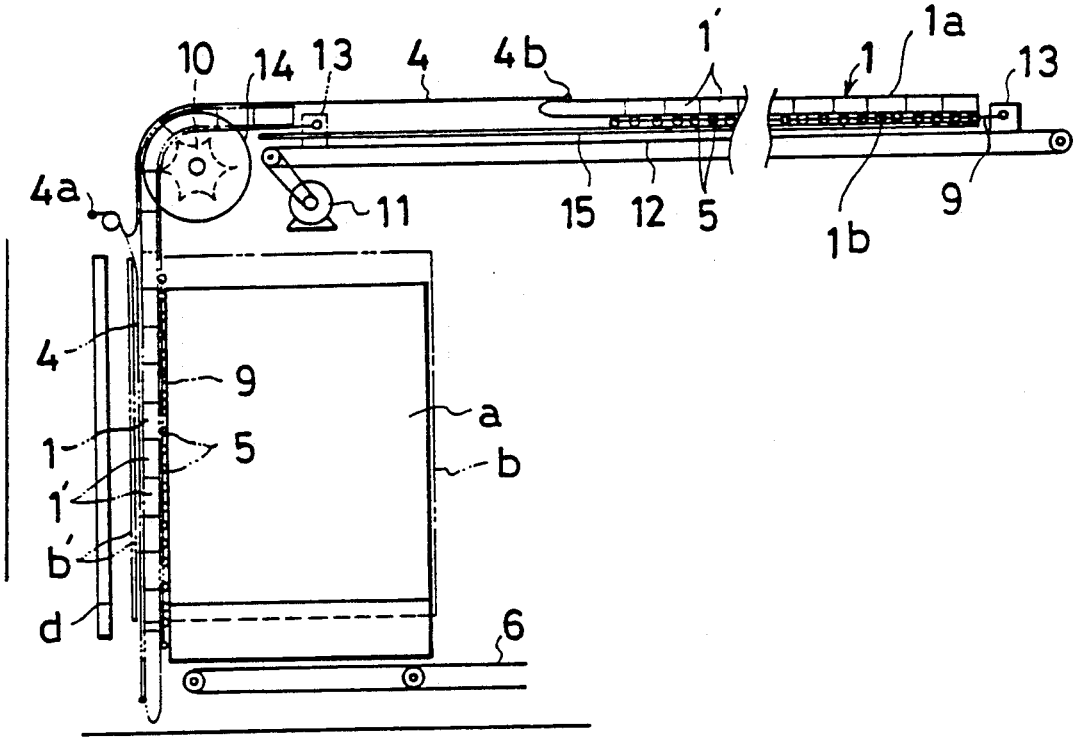
FIG. 8 is a side elevational view of an apparatus provided with a sheet member only at a front side of the chained support member.

Referring now to FIG. 8 and subsequent figures, an embodiment of the present invention will be described in which the support member (1) is made in the form of freely bendable chained member. This arrangement can eliminate the above-mentioned disadvantages.

The support member (1) is made up of a plurality of short members (1') with their front surface being used as the supporting surface (1*a*) during the fusing operation. The short members (1') are connected in series with chained elements (9) such as chains and the like and consequently the support member (1) is formed as a chain having a length extending over the width of the film (b). In the case of FIG. 8, the sheet member (4) is set along a front surface of the chained support member (1) and the small diameter rollers (5) are arranged at a rear surface of the support member (1).

Figure 9:
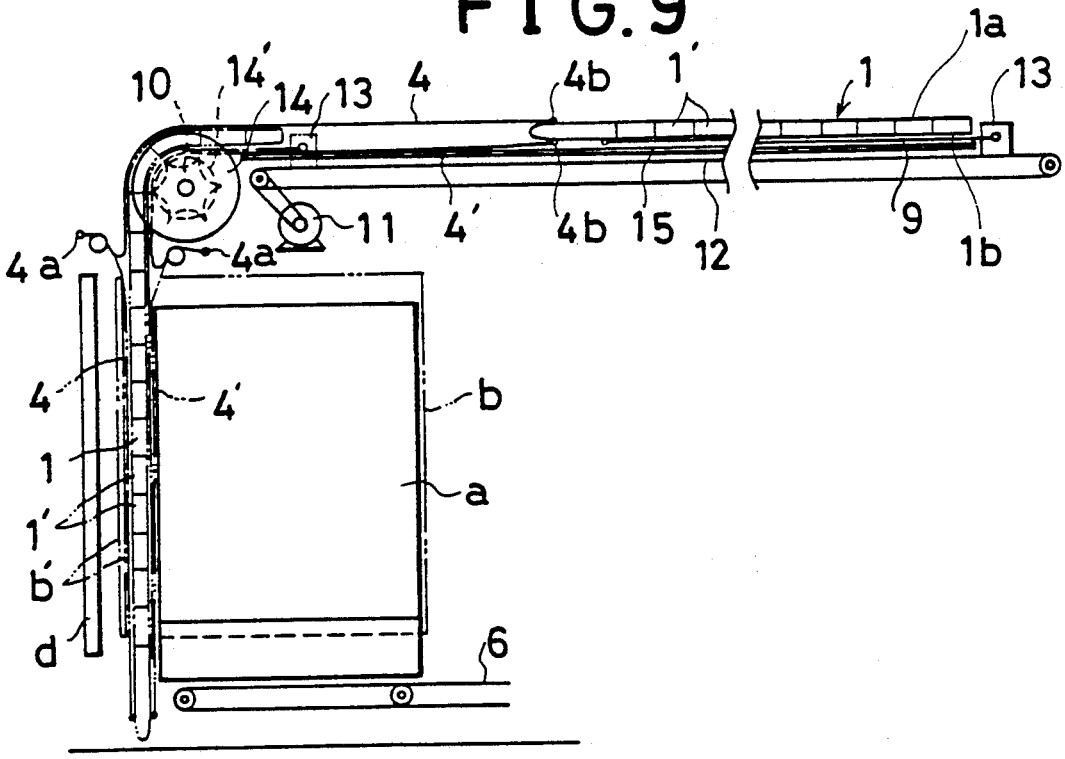
FIG. 9 is a side elevational view of an apparatus provided with sheet members at the front and rear sides of the chained support member.

FIG. 9 illustrates an arrangement in which the sheet members (4) and (4') are set along both front and rear sides of the support member (1). In these embodiments, the chained elements (9), such as chains having each of the short members (1') connected to each other, are meshed with a star-shaped sprocket wheel (10), thereby bending and changing the feeding and withdrawing direction of the support member (1) with respect to the fusion-processing position.

The pulling-out direction of the support member (1) is changed in a horizontal direction with respect to the vertically extending fused adhesion line in the illustrated example. A base end of the chained element (9) is connected to a moving element (13) which is connected to a moving belt or a chain (12) driven in either direction of rotation by a motor (11). The chained support member (1) can thus be fed and withdrawn by operation of the moving element (13) between a standby position indicated by a solid line and the fusion-processing position located at the front surface of the article (a) shown in an imaginary line in each of FIGS. 8 and 9.

Further, the sheet member (4) is provided with one end (4*a*) being fixed and the other end (4*b*) being fixed to the tip end of the chained support member (1) in the same manner as in FIGS. 1 and 2. Therefore, along with feeding and withdrawing movement of the support member (1), when the support member (1) is fed, the sheet member (4) is set along the supporting surface (1*a*) and in turn when the support member (1) is withdrawn, the sheet member (4) is rolled up while it is being peeled off toward the side of said support member from the inner surface of the film (b).

When the sheet member (4') is arranged at a rear surface, friction between the chained support member (1) and the film (b) or the article (a) is also prevented by feeding and withdrawing the sheet member (4'). In these examples, reference numerals (14) and (14') denote supporting wheels for the sheet members (4) and (4'). Reference numeral (15) denotes a support plate for supporting the chained support member (1) at its standby position.

Figure 10:
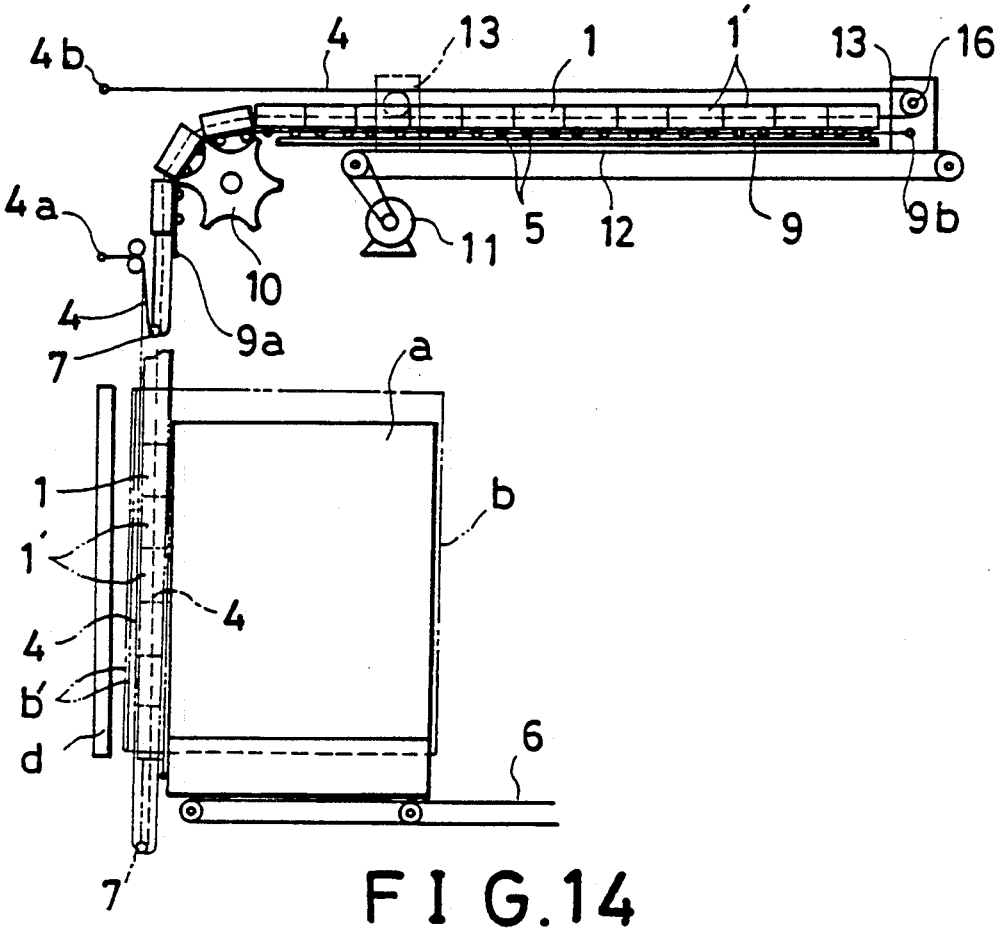
FIG. 10 is a side elevational view showing an apparatus provided with a sheet member only at a front side of the chained support member.
Figure 11:
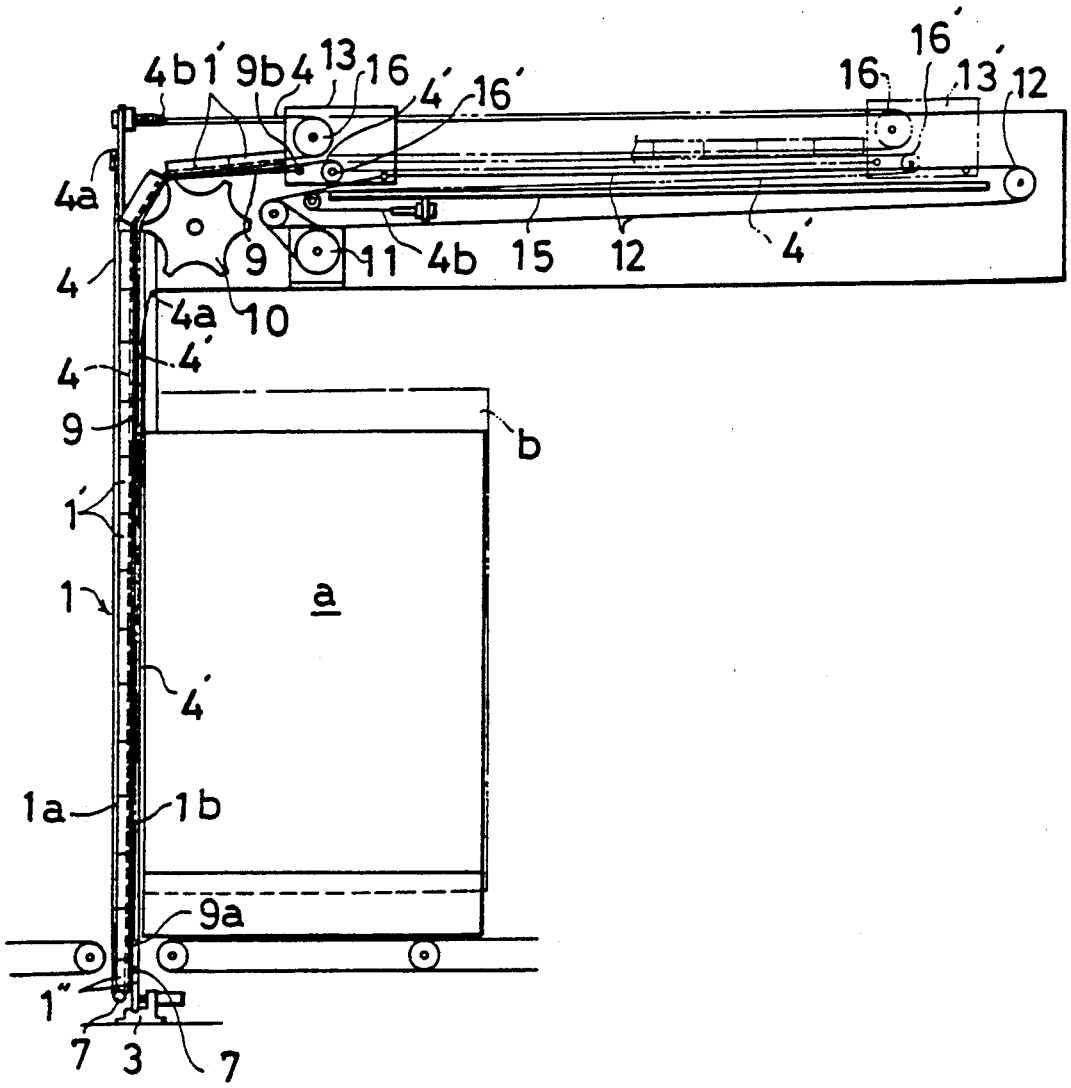
FIG. 11 is a side elevational view showing an apparatus provided with sheet members at the front and rear sides of the chained support member.

Further, FIGS. 10 and 11 illustrate embodiments in which the sheet members (4) and (4') are inserted via the tip end of the chained support member (1) into the support member, thereafter each of them is pulled out from the other ends. In this case, the feeding and withdrawing distance of the chained support member (1) is reduced in the same manner as in the embodiments shown in FIGS. 6 and 7.

FIG. 10 illustrates an embodiment in which the sheet member (4) is arranged only at the supporting surface (1*a*) of the support member (1), wherein the sheet member (4) is arranged with its one end (4*a*) being fixed and the sheet member passes through a small diameter roller (7) at the tip end of the support member (1) and passes through the short members (1') in sequence. Thereafter, the sheet member (4) is taken out of the other end of the support member (1) and its terminal end (4*b*) is fixed. At the same time the sheet member (4) between the fixed terminal end (4*b*) and the other end of the support member (1) is passed around the moving wheel (16) pivotally supported at the moving element (13) fixed to a moving chain (12) to be driven by a motor (11) so as to perform a feeding and withdrawing of the sheet member (4).

Thus, the sheet member (4) is fed and withdrawn with respect to the fusion-processing position together with the support member (1) connected to the moving element (13) by the chained element (9). Thus, the sheet member (4) can be fed and withdrawn in response to an amount of movement of the moving element (13) which is relatively short and equivalent to a moving amount of the support member (1).

Then, referring now to FIGS. 11 to 14, details of a case in which the front and rear surfaces of the chained support member (1) are provided with the sheet members (4) and (4') will be described.

Figure 14:
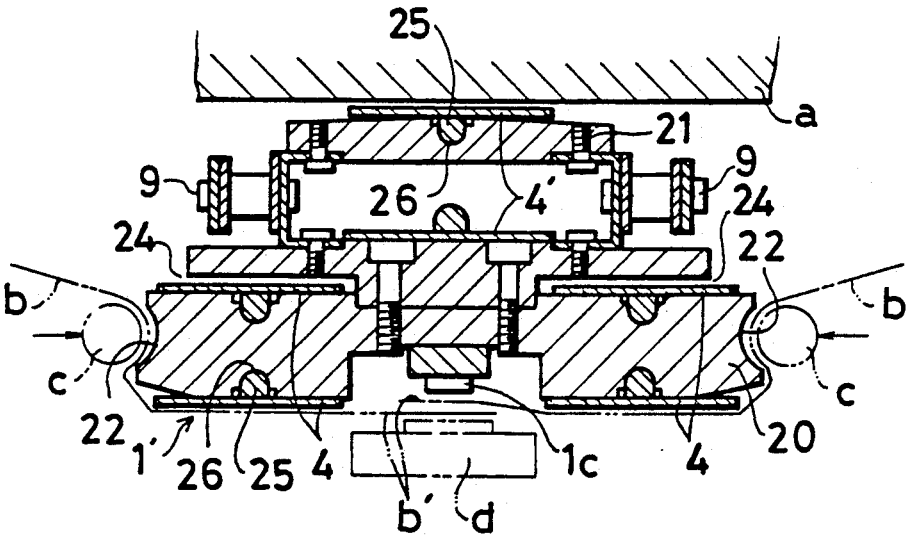
FIG. 14 is a sectional view taken along a line XIV—XIV of FIG. 12.

Each of the short members (1') constituting the chained support member (1) includes a front piece (20) and a rear piece (21) as shown in FIG. 14. An appropriate number of pieces are connected by chains (9), with both sides of the rear of each of the front pieces (20) to provide a predetermined length. An auxiliary short member (1'') is connected to the extreme piece so that they form a freely bendable chained support member (1).

One end (9*a*) of the chain (9) is connected to the auxiliary short piece (1'') and the other end (9*b*) thereof is connected to the moving element (13). As the moving element (13) is moved, the chained support member (1) is fed and withdrawn with respect to the fusion-processing position at the front surface of the article (a). Each of the rear pieces (21) is integrally fixed to each of the front pieces (20) by means of the chains (9), (9).

A surface of each of the front pieces (20) is provided with a fusing die member (1*c*) of the fused adhesion line of an arbitrary shape for use in fusing the film. A continuous fused adhesion line of a predetermined length is formed by connecting all short members (1'). In this case, in order to prevent the fused adhesion line from being cut in the middle, it is preferable that the connecting portions of the short members (1') do not generate any clearance at the connecting portions of the short members (1'). However, it may also be possible that the long die member of resilient material having that fused adhesion line of a predetermined length which is longer than each of the short members (1') is fixed to the chained support member (1), instead of providing a short member with a fused adhesion line.

In addition, both sides of the front piece (20) are formed with recessed portions (22) having an appropriate shape and, as illustrated in FIG. 3 as above, the film (b) wound around the article (a) is pressed and held against the sides of the support member (1) by movable bars (c) and (c). When both cut end portions (b') and (b') of the film (b) are overlapped on the surface of the chained support member, the movable bars (c) are fitted into the recessed portions (22), and the short members (1') connected in a chained manner are pressed and held by the movable bars (c) and (c) with their front, rear, right and left sides being restricted.

A deformation caused by the chained condition is therefore prevented by placing all the short members (1') in an integrally fixed condition. Thus, an accurate alignment of the fused adhesion line is performed. Further, when the chained support member (1) is fed into the fusion-processing position, an engaging device (3) advanced by either a solenoid or a cylinder mechanism is thrust into an engaging hole (23) of the auxiliary short member (1'') and the support member (1) is kept stationary.

Each of the ends (4*a*) of the sheet members (4) and (4') set along the front and rear surfaces of the chained support member (1) (front sheet members (4) are two in number) is fixed. The front sheet members (4) are inserted into clearances (24) formed at both sides of the rear of each of the front pieces (20) and the rear sheet member (4') is passed through an inner surface of the rear piece (21). Thereafter they are pulled out from the other end of the support member (1) and each of the other ends (4*b*) of the sheet members is fixed. The sheet members (4) and (4') between the fixed ends (4*b*) and the other end of the support member (1) are passed around each of the moving wheels (16) and (16') pivotably supported at the moving element (13). The sheet members are fed and withdrawn with respect to the fusion-processing position at the front of the article (a) together with the support member (1) as the moving wheels (16) and (16') are moved. The operation described above is the same as these of the previous embodiments.

The sheet members (4) set along the front and rear surfaces of the front piece (20) of each of the short members (1') are provided longitudinally with a projection (25) on the surfaces contacting the front piece (20). The sheet member (4') set along the rear surface of the rear piece (21) is provided longitudinally with another projection (25) on the surface contacting the rear piece (21). These projections are fitted to the recessed portions (26) formed in each of the front piece (20) and the rear piece (21) so as to prevent a displacement in position of each of the sheet members (4) and (4'). Then the feeding and withdrawing operation can be securely carried out.

In each of the above-mentioned embodiments, it is illustrated that a feeding or withdrawing direction of the support member (1) is set in a vertical direction because the film (b) wound around the article (a) is fused along a vertical fused adhesion line. However, in the case that the fused adhesion line is set in a horizontal direction, the feeding and withdrawing direction of the support member (1) can also be set in a horizontal direction accordingly.

Additionally, in each of the above-mentioned embodiments, when both end portions (b') and (b') of the film (b) wound around the article (a) are overlapped and fused, both cut end portions of the film (b), each being connected to each of the winding rollers, are overlapped and fused together for being ready for the next packaging operation.

The advantages of apparatus including the principles of the present invention have been described. The support member to be used for overlapping and fusing both end portions of the film wound around the article is fed in and withdrawn from the fusion-processing position. In this case, a smooth sheet member is interposed between the supporting surface of the support member and the packaging film or between the supporting surface of the support member and the surface of the article at the front and rear portions of the support member. Thus, the inconvenience caused by friction engagement between the support member and the film or the article can be eliminated.

In particular, after the fusing operation, even though the film is apt to be strongly urged towards the support member due to its shrinkage the apparatus incorporating the principles of the present invention provides an easy withdrawing of the support member and further prevents the film and the article from being damaged due to the fact that the sheet member is withdrawn while it is being peeled off inwardly from an inner surface of the film. Furthermore, since the freely bendable chained support member is attained by connecting a plurality of short members, the support member can be fed in and withdrawn with respect to the fusion-processing position in a bending direction without being limited to a plane including the fused adhesion line of the film. This facilitates the setting of the feeding and withdrawing space for the support member.

I claim:

1. Apparatus for use in fusing together the overlapping edges of a packaging film wrapped around an article, including a support member arranged to be located in a fusion-processing position between the said overlapping edges and the article during the fusing operation; means for feeding the said support member to, and withdrawing it from, said fusion-processing position, substantially along the line of the said overlapping edges; and a flexible sheet member arranged to be located between the said support member and either the said overlapping edges or the article during the fusing operation; the said sheet member being connected to the support member in such manner that it is gradually peeled off toward the side of said support member from either the said overlapping edges or the article as the support member is withdrawn from its fusion-processing position.

2. Apparatus as in claim 1, wherein the said sheet member is arranged to be located between the said support member and said overlapping edges during the fusing operation.

3. Apparatus as in claim 2, including a second sheet member arranged to be located between said support member and the said article during the fusing operation.

4. Apparatus as in claim 1, wherein the said support member is a substantially straight rigid member.

5. Apparatus as in claim 1, wherein the said support member is a flexible member.

6. Apparatus as in claim 5, wherein said support member comprises a chain of short elements.

7. Apparatus as in claim 5, wherein the path of movement of the support member to and from said fusion-processing position turns through an appropriate angle adjacent the fusing station.

8. Apparatus as in claim 7, wherein the path of movement of the support member to and from said fusion-processing position turns through an angle of the order of 90° adjacent the fusing station, whereby when the support member is in a standby position it extends substantially perpendicular to the line of the said overlapping edges.

9. Apparatus as in claim 1, wherein one end of each said sheet member is fixed in position and the other end is connected to the leading end of the support member.

10. Apparatus as in claim 1, wherein one end of each sheet member is fixed in position and the other end is connected to take-up means, the sheet member extending longitudinally through the said support member between its said ends.

11. Apparatus as in claim 2, wherein the said support member is a substantially straight rigid member.

12. Apparatus as in claim 3, wherein the said support member is a substantially straight rigid member.

13. Apparatus as in claim 2, wherein the said support member is a flexible member.

14. Apparatus as in claim 3, wherein the said support member is a flexible member.

15. Apparatus as in claim 6, wherein the path of movement of the support member to and from said fusion-processing position turns through an appropriate angle adjacent the fusing station.

16. Apparatus as in claim 2, wherein one end of each sheet member is fixed in position and the other end is connected to take-up means, the sheet member extending longitudinally through the said support member between its said ends.

17. Apparatus as in claim 3, wherein one end of each sheet member is fixed in position and the other end is connected to take-up means, the sheet member extending longitudinally through the said support member between its said ends.

18. Apparatus as in claim 4, wherein one end of each sheet member is fixed in position and the other end is connected to take-up means, the sheet member extending longitudinally through the said support member between its said ends.

19. Apparatus as in claim 5, wherein one end of each sheet member is fixed in position and the other end is connected to take-up means, the sheet member extending longitudinally through the said support member between its said ends.

20. Apparatus as in claim 6, wherein one end of each sheet member is fixed in position and the other end is connected to take-up means, the sheet member extending longitudinally through the said support member between its said ends.

* * * * *